US009505242B2

(12) United States Patent
Segawa

(10) Patent No.: US 9,505,242 B2
(45) Date of Patent: Nov. 29, 2016

(54) RECORDING APPARATUS

(71) Applicant: SEIKO EPSON CORPORATION, Tokyo (JP)

(72) Inventor: Yuichi Segawa, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/057,459

(22) Filed: Mar. 1, 2016

(65) Prior Publication Data

US 2016/0257137 A1 Sep. 8, 2016

(30) Foreign Application Priority Data

Mar. 5, 2015 (JP) ..... 2015-043491

(51) Int. Cl.
*B41J 11/00* (2006.01)

(52) U.S. Cl.
CPC ..... *B41J 11/007* (2013.01)

(58) Field of Classification Search
None
See application file for complete search history.

(56) References Cited

U.S. PATENT DOCUMENTS

2005/0169667 A1* 8/2005 Katoh ..... G03G 21/168 399/121

FOREIGN PATENT DOCUMENTS

JP 2005-189664 7/2005
JP 2009-241355 10/2009

* cited by examiner

*Primary Examiner* — Bradley Thies
(74) *Attorney, Agent, or Firm* — Workman Nydegger

(57) ABSTRACT

A recording apparatus includes a recording section, a transportation unit, and a supporting frame. The recording section performs recording on paper. The transportation unit includes a transportation belt and a moving section. The transportation belt can transport the paper by turning. The moving section causes the transportation belt to move between a recording position, at which the recording is performed by the recording section, and a retracted position, which is more distant from the recording section than the recording position is. The supporting frame supports the transportation unit inside. A first opening portion is formed in the supporting frame. Through the first opening portion, the transportation unit supported inside the supporting frame can be drawn out from the inside of the supporting frame to the outside of the supporting frame in a state in which the transportation belt has been moved to the retracted position.

12 Claims, 10 Drawing Sheets

RECORDING APPARATUS

BACKGROUND

1. Technical Field

The present invention relates to a recording apparatus provided with a transportation belt for transporting a recording target medium.

2. Related Art

An ink-jet printer known as a kind of a recording apparatus is provided with a recording section that records (prints) an image, etc. on paper, which is an example of a recording target medium. Ink, as an example of liquid (recording liquid), is ejected from the recording section onto the paper transported by an endless transportation belt that is stretched with a tension between rollers and turns.

In such a printer, for example, the deterioration of the belt (transportation belt) sometimes occurs due to a change in stress, etc. applied to the belt when the belt turns. Therefore, the printer has a belt-replaceable structure. Specifically, a structure in which a belt unit (transfer belt unit) including a belt (transfer belt) stretched with a tension between rollers is detachably attached into an apparatus body has been proposed (for example, refer to JP-A-2005-189664).

However, in the art, the belt unit is drawn out to the outside of the frame of the apparatus body from a state in which the belt is located at a position (recording position) where it faces a photosensitive member (recording section), which forms (records) a color toner image (image) onto the belt. Therefore, if the above structure is employed in an ink-jet printer, the transportation belt is drawn out while facing the recording section. In this process, for example, there is a possibility that the transportation belt might come into contact with the recording section by moving in a direction intersecting with the drawing-out direction due to a typical clearance left for smooth drawing-out operation, or might scrape against the recording section. There is a risk that this might make the image recording quality of the recording section poor.

The problem described above is almost common to recording apparatuses comprising: a recording section that performs recording on a recording target medium; a transportation unit that includes a transportation belt for transporting the recording target medium; and a supporting frame that supports the transportation unit inside.

SUMMARY

An advantage of some aspects of the invention is to provide a recording apparatus that makes it possible to do transportation belt replacement work easily while avoiding contact with a recording section.

Solving means according to some aspects, and operational effects thereof, are described below.

A recording apparatus according to one aspect comprises: a recording section that performs recording on a recording target medium; a transportation unit that includes, a transportation belt that is capable of transporting the recording target medium by turning, and a moving section that causes the transportation belt to move between a first position, at which the recording is performed by the recording section, and a second position, which is more distant from the recording section than the first position is; and a supporting frame that supports the transportation unit inside, wherein an opening portion is formed in the supporting frame, and wherein, through the opening portion, the transportation unit supported inside the supporting frame can be drawn out from inside of the supporting frame to outside of the supporting frame in a state in which the transportation belt has been moved to the second position.

With this structure, the transportation unit can be drawn out to the outside of the supporting frame at the position away from the recording section. Therefore, an operator can do transportation belt replacement work easily while avoiding contact with the recording section.

Preferably, the recording apparatus described above should further comprise: a connection section for mechanical connection between the transportation belt and the moving section, wherein a state of the connection section can be switched between a connected state, in which the movement of the transportation belt between the first position and the second position by the moving section is enabled, and a disconnected state in which the movement therebetween is disabled.

With this structure, for example, it is possible to detach the transportation belt from the transportation unit by switching the state of the connection section, which mechanically connects the transportation belt and the moving section to each other, into the disconnected state. This makes it easier to do the transportation belt replacement work.

Preferably, in the recording apparatus described above, the transportation unit should include a driving roller that causes the transportation belt to turn by rotating, a bearing that has an insertion receptacle into which a shaft of the driving roller can be inserted, and rotatably supports the shaft inserted into the insertion receptacle, and a cover portion whose position can be changed between a closed state, in which the insertion receptacle of the bearing is covered, and an open state, in which the insertion receptacle is exposed.

With this structure, it is possible to detach the transportation belt from the transportation unit by putting the driving roller inserted in the bearing out of the bearing from the exposed insertion receptacle. Therefore, the user/operator can do the transportation belt replacement work easily.

Preferably, in the recording apparatus described above, the transportation belt should move between the first position and the second position by drawing an arc around the shaft of the driving roller.

By this means, with a structure that is simpler than, for example, a parallel movement structure, it is possible to cause the transportation belt to move between the first position and the second position.

Preferably, in the recording apparatus described above, a detection sensor for detecting an amount of rotation of the driving roller should be provided on the cover portion.

The state of the movement of the transportation belt to the second position can be detected on the basis of the amount of rotation of the driving roller. Therefore, with this structure, it is possible to draw out the transportation unit to the outside of the supporting frame easily.

Preferably, in the recording apparatus described above, either a transportation driving source that causes the transportation belt to turn or a movement driving source that drives the moving section so as to cause the transportation belt to move between the first position and the second position, or both, should be provided on the transportation unit.

In this structure, when the transportation unit is drawn out to the outside of the supporting frame, the driving source is, or the driving sources are, moved together therewith. Therefore, it is not necessary to provide any separable driving transmission mechanism between the driving source(s) and the transportation/movement mechanism. This makes it possible to avoid the structure of the transportation unit from becoming complex.

Preferably, the recording apparatus described above should further comprise: an apparatus frame inside which the supporting frame is fixed, wherein a hole portion through which the entire opening portion formed in the supporting frame is exposed is formed in the apparatus frame at a position where the hole portion overlaps with the opening portion in two-dimensional view in a direction in which the transportation unit is drawn out.

With this structure, the transportation unit can be drawn out of the supporting frame easily through the opening portion, which is exposed through the hole portion. In addition, the contact of the transportation unit that is being drawn out with the apparatus frame is prevented.

Preferably, in the recording apparatus described above, when the hole portion is defined as a first hole portion, a second hole portion that does not overlap with the first hole portion in two-dimensional view in the drawing-out direction mentioned above should be formed in the apparatus frame at a downstream side in a transportation direction of the recording target medium with respect to the first hole portion.

With this structure, the recording target medium jammed, etc. during transportation can be taken out of the apparatus frame through the second hole portion.

Preferably, in the recording apparatus described above, when the opening portion is defined as a first opening portion, a second opening portion should be formed in the supporting frame at the downstream side in the transportation direction of the recording target medium with respect to the first opening portion; and the second hole portion of the apparatus frame should be formed at a position where the second hole portion overlaps with the second opening portion of the supporting frame in two-dimensional view in the drawing-out direction mentioned above.

With this structure, the recording target medium jammed, etc. during transportation inside the supporting frame can be taken out of the supporting frame to the outside of the apparatus frame easily through the second opening portion, and through the second hole portion overlapping with the second opening portion in two-dimensional view.

BRIEF DESCRIPTION OF THE DRAWINGS

The invention will be described with reference to the accompanying drawings, wherein like numbers reference like elements.

DESCRIPTION OF EXEMPLARY EMBODIMENTS

With reference to the accompanying drawings, an ink-jet printer, as an example of a recording apparatus according to an exemplary embodiment of the invention, will now be explained. The ink-jet printer is provided with a recording section that ejects ink, which is an example of liquid, onto paper, which is an example of a recording target medium, to print (record) an image that includes characters, figures, and the like.

Figure 1:
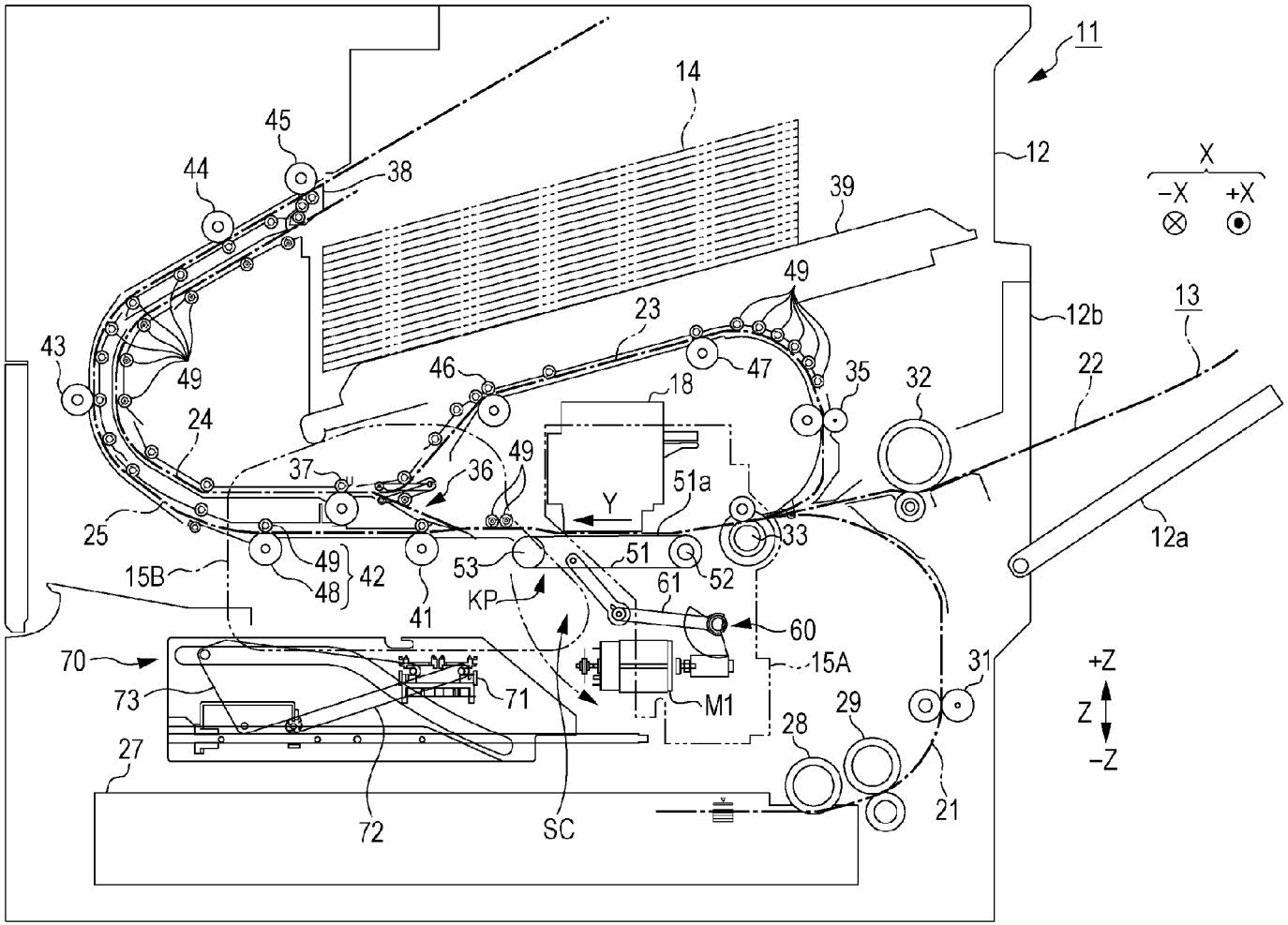
FIG. 1 is a schematic structure diagram of a printer that is an example of a recording apparatus according to an exemplary embodiment.

As illustrated in FIG. 1, a printer 11, as an example of a recording apparatus according to the present embodiment, includes a cabinet 12 and a plurality of pairs of rollers. The cabinet 12 has a shape of a substantially rectangular parallelepiped and includes a plurality of armor cases, etc. The plural pairs of rollers transports paper 14 along a transportation path 13, which is indicated by a heavy dot-and-dash line in FIG. 1. A transportation belt 51 and a recording section 18 are provided beside the transportation path 13. The transportation belt 51 transports the paper 14 while supporting the paper 14 from the −Z side in the vertical direction Z (from below), which is along the direction of gravity. The transportation belt 51 and the recording section 18 are configured to face each other, and the transportation path 13 goes therebetween.

In the present embodiment, the recording section 18 is a so-called line head. More specifically, the recording section 18 has a liquid ejecting head that is capable of ejecting ink simultaneously throughout the length direction, wherein the length direction is the width direction X intersecting with (in this embodiment, orthogonal to) the transportation direction Y of the paper 14. To facilitate the explanation below, regarding the width direction X, the direction toward the left when viewed from the upstream side in the transportation direction Y (the direction toward the front of the sheet of the drawing) is defined herein as +X direction, and the direction toward the right when viewed from the upstream side in the transportation direction Y (the direction toward the back of the sheet of the drawing) is defined herein as −X direction.

The recording section 18, which is a line head in the embodiment, performs printing by ejecting ink from +Z side, that is, from the opposite side as viewed in the direction of gravity (from above), toward the paper 14 that is transported in a state of being supported by the transportation belt 51. The position of the transportation belt 51 at the time of printing (recording) an image on the paper 14 by the recording section 18, that is, the position where the transportation belt 51 and the recording section 18 face each other (first position), is hereinafter referred to as a recording position KP.

The transportation path 13 is made up of a first supply path 21, a second supply path 22, a third supply path 23, a branch path 24, and a paper ejection path 25. The first supply path 21 and the second supply path 22 are located upstream of the recording section 18 in the transportation direction Y. The third supply path 23, the branch path 24, and the paper ejection path 25 are located downstream of the recording section 18 in the transportation direction Y.

The first supply path 21 is a path connecting a paper cassette 27 to the recording section 18. The paper cassette 27 is inserted in, and can be drawn out of, the bottom portion of the cabinet 12, wherein the bottom portion is located at the −Z side as viewed in the direction of gravity. A pickup roller 28 and a separation roller 29 are provided on the first supply path 21. The pickup roller 28 picks up the top paper 14 out of a stack of the paper 14 in the paper cassette 27. The separation roller 29 performs sheet separation operation for the paper 14 fed by the pickup roller 28 so that one sheet will be fed each time. A first supply roller pair 31 is provided downstream of the separation roller 29 in the transportation direction Y.

The second supply path 22 is a path connecting an insertion portion 12*b* to the recording section 18. The insertion portion 12*b* becomes exposed when a cover 12*a*, which is provided on one side of the cabinet 12, is opened. A second supply roller pair 32, which transports the paper 14 inserted from the insertion portion 12*b* while nipping the paper 14 between the two rollers, is provided on the second supply path 22. A third supply roller pair 33 is provided at a position where the first supply path 21, the second supply path 22, and the third supply path 23 merge. A fifth supply roller pair 35 is provided on the third supply path 23.

The third supply path 23 is a path that is formed in such a way as to surround the recording section 18. The paper 14 having passed through the recording section 18 can be returned to a position upstream of the recording section 18 via the third supply path 23. Specifically, a branch mechanism 36 is provided downstream of the recording section 18, and, in addition, a branch roller pair 37, which can be rotated both in the normal direction and in the reverse direction, is provided on the branch path 24 branching from the paper ejection path 25.

The paper ejection path 25 is a path connecting the recording section 18 to an ejection port 38, through which the paper after the completion of printing is ejected. The paper 14 ejected through the ejection port 38 is stacked onto an ejection table 39. At least one transportation roller pair (in the present embodiment, first transportation roller pair 41 to fifth transportation roller pair 45) is provided on the paper ejection path 25. A sixth transportation roller pair 46 and a seventh transportation roller pair 47 are provided on the third supply path 23. These first to seventh transportation roller pairs 41 to 47 transport the paper 14, with ink thereon, while nipping the paper 14 each therebetween.

Specifically, each of the first to seventh transportation roller pairs 41 to 47 is made up of a columnar driving roller 48 and a toothed roller 49. The driving roller 48 rotates by receiving the driving force of a driving source. The toothed roller 49 is a driven roller that rotates when the driving roller 48 rotates. In addition to the toothed rollers 49 paired with the respective driving rollers 48 as described above, non-paired standalone toothed rollers 49 are provided. Specifically, the toothed rollers 49 are provided on the third supply path 23, the branch path 24, and the paper ejection path 25 at the side at which the printed side of the paper 14 after the completion of printing passes therethrough (that is, the paper surface onto which ink as an example of liquid has been ejected). In addition, the toothed rollers 49 are provided each between two adjacent roller pairs in the transportation direction among the first to seventh transportation roller pairs 41 to 47. Moreover, the toothed rollers 49 are provided between the transportation roller pairs and the recording section 18. On the other hand, the driving rollers 48 are provided at the side at which the non-printed side (non-recorded surface) of the paper 14 passes therethrough, or, in a case of printing on both sides of the sheet of the paper 14, at the side at which one paper surface printer earlier than the other passes therethrough.

In the present embodiment, the transportation belt 51 located at the recording position KP where the transportation belt 51 and the recording section 18 face each other transports the paper 14 in a state in which, due to electrostatic attraction, the paper 14 is supported on the belt surface 51*a* of the transportation belt 51. The belt surface 51*a* is the upper surface facing toward the recording section 18 at the opposite +Z side as viewed in the direction of gravity. Specifically, the transportation belt 51 is an endless belt that is stretched with a tension between two rollers. One of the two rollers is a driving roller 52, which rotates when it is driven by a driving source. The other is a driven roller 53, which rotates when the driving roller 52 rotates. The transportation belt 51 turns when the driving roller 52 rotates. The transportation belt 51 is charged with static electricity by a charging roller that is not illustrated in the drawings. When the transportation belt 51 turns, the static electricity attracts the paper 14 onto the belt surface 51*a*, which is the flat upper surface between the driving roller 52 and the driven roller 53. The paper 14 in the attracted state is transported in the transportation direction Y while facing toward the recording section 18.

In the present embodiment, the printer 11 is provided with a moving section 60. The moving section 60 causes the transportation belt 51 to move from the recording position KP, at which printing is performed by the recording section 18, to the second position, which is more distant from the recording section 18 than the recording position KP is. The moving section 60 includes a link member 61, which operates when a first motor M1 functioning as a driving source (movement driving source) rotates. Driven by the first motor M1, the link member 61 causes the driven roller 53 of the transportation belt 51 to draw an arc around the driving roller 52, which is the center, toward the −Z side as viewed in the direction of gravity as indicated by the dot-dot-dash-line arrow in FIG. 1, thereby causing the transportation belt 51 to move from the recording position KP, which is the first position, to the second position, which is comparatively distant from the recording section 18.

Figure 2:
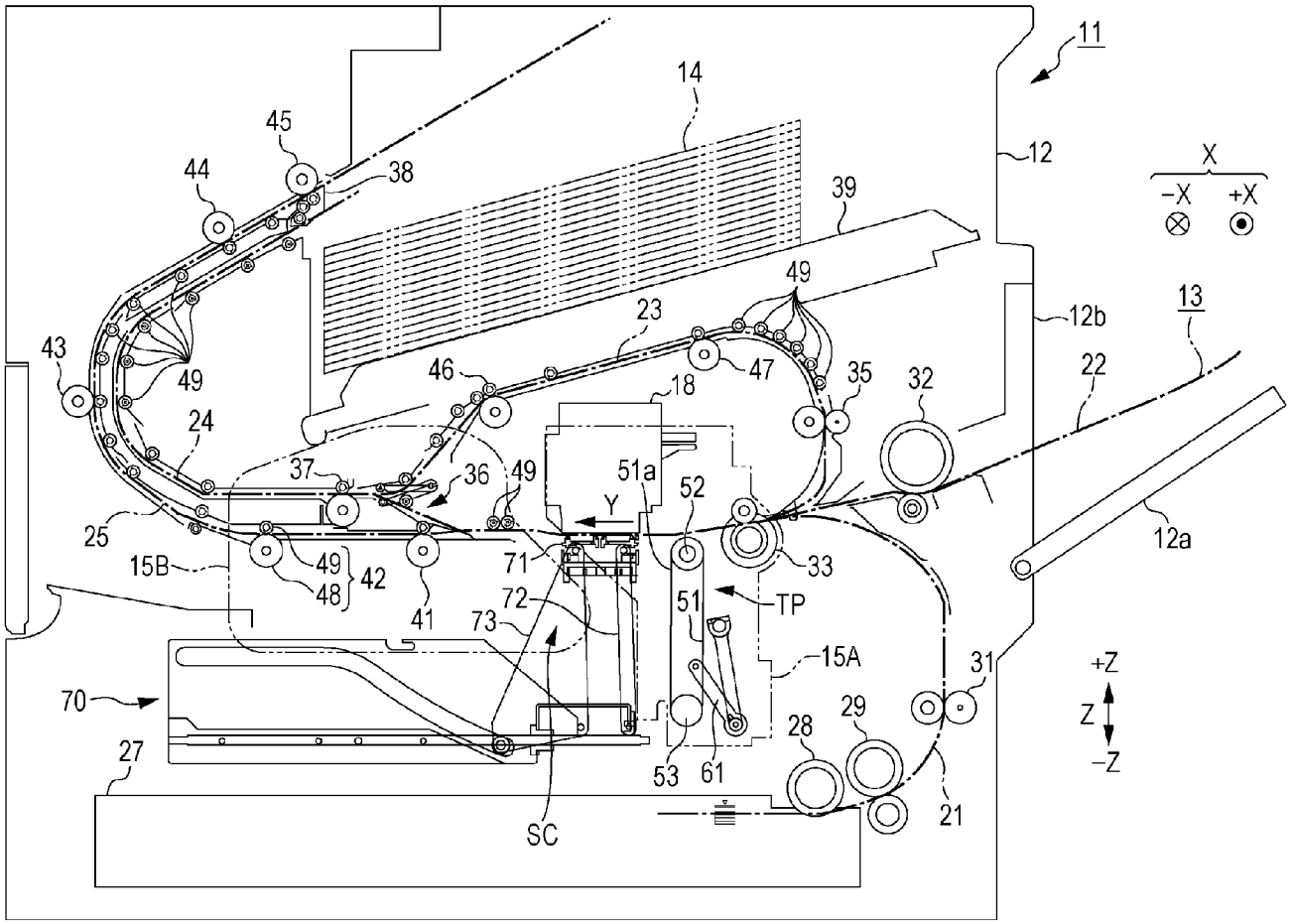
FIG. 2 is a schematic structure diagram that illustrates a state in which a transportation belt has been moved away from a recording section, wherein a cap is in contact with the recording section.

As illustrated in FIG. 2, in the present embodiment, the second position is the position after the rotation (arc-drawing movement) of the transportation belt 51 by approximately 90° around the driving roller 52 from the recording position KP. The second position is hereinafter referred to as a retracted position TP. In the present embodiment, the belt surface 51*a* of the transportation belt 51 is substantially horizontal at the recording position KP, and is substantially perpendicular, that is, along the vertical direction Z, at the retracted position TP.

When the transportation belt 51 is located at the retracted position TP, recording onto the paper 14 is not performed by the recording section 18. Therefore, as illustrated in FIG. 2, for example, for the purpose of maintaining the recording capability of the recording section 18, the printer 11 is provided with a cap movement mechanism 70, which brings a cap 71 into contact with the recording section 18 that is in the above-described state of non-recording from the −Z side as viewed in the direction of gravity, thereby capping the recording section 18. The cap movement mechanism 70 has a structure of causing the cap 71 to move up and down in the vertical direction Z (lifting and lowering) by means of its link mechanism when members 72 and 73, which support the cap 71, reciprocate in the transportation direction Y. As illustrated in FIG. 1, in a state in which the recording section 18 is not capped, the cap 71 and the members constituting the cap movement mechanism 70 (for example, the cap 71 and the members 72 and 73) are located at the position where they do not obstruct the movement of the transportation belt 51 when the transportation belt 51 moves (draws an arc) between the recording position KP and the retracted position TP as indicated by the dot-dot-dash-line arrow in the drawing. In other words, the transportation belt 51 is configured not to collide with the cap 71 and the cap movement mechanism 70 during movement between the recording position KP and the retracted position TP when the recording section 18 is not sealed by the cap 71.

Figure 3:
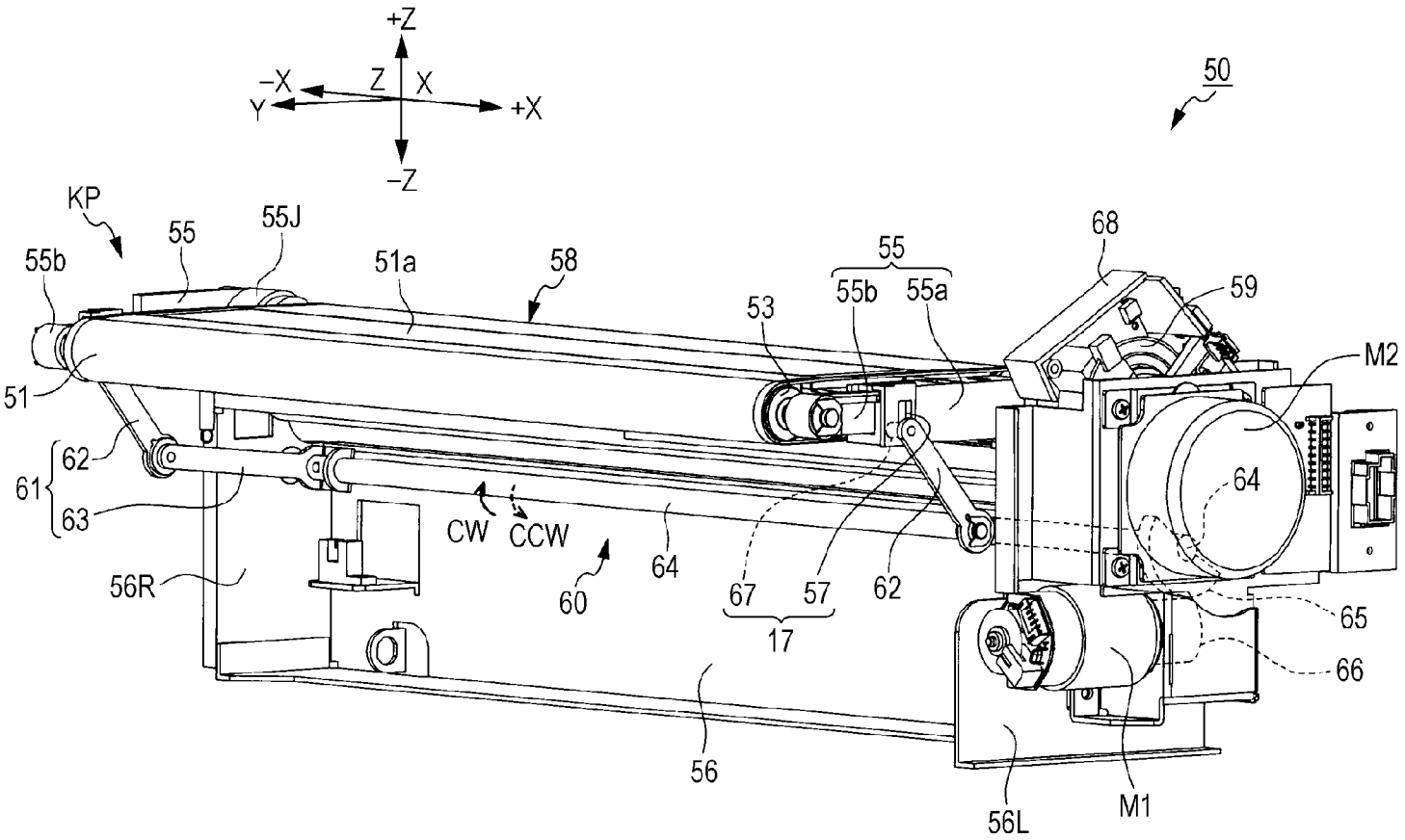
FIG. 3 is a perspective view that illustrates a transportation unit after the movement of the transportation belt to a position where recording is performed by the recording section.
Figure 4:
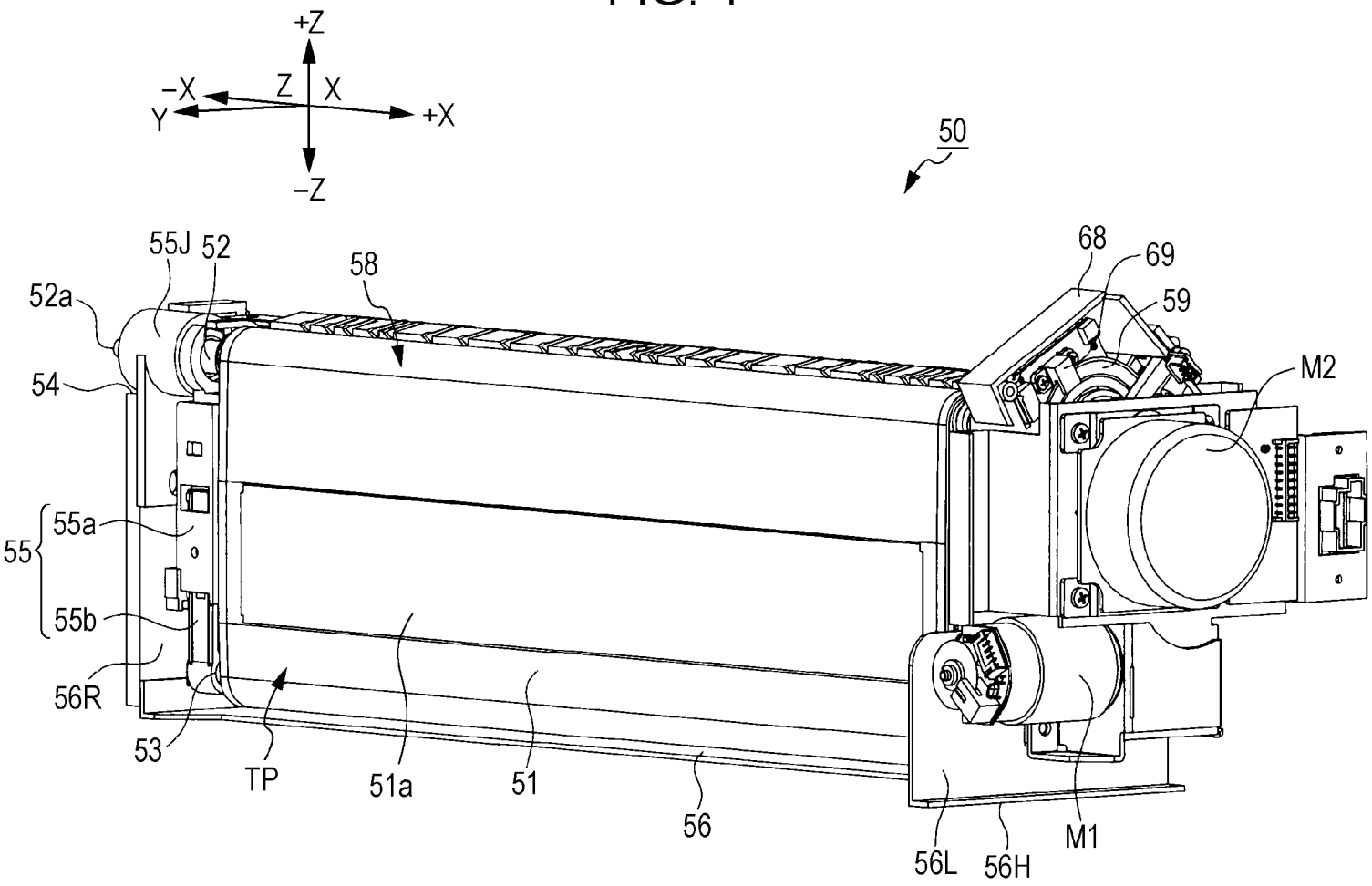
FIG. 4 is a perspective view that illustrates the transportation unit after the movement of the transportation belt to a position away from the recording section.

As illustrated in FIGS. 3 and 4, in the present embodiment, the transportation belt 51 and the moving section 60 are constituents of a transportation unit 50, which is an assembled unit including the first motor M1. FIG. 3 illustrates the transportation unit 50 in a state in which the transportation belt 51 is located at the recording position KP as in FIG. 1. FIG. 4 illustrates the transportation unit 50 in a state in which the transportation belt 51 is located at the retracted position TP as in FIG. 1.

As illustrated in FIG. 3, the transportation unit 50 has its length in the width direction X. The transportation unit 50 includes a unit frame 56, which has a side plate portion 56R at the right end (−X direction) in the direction of its length and a side plate portion 56L at the left end (+X direction) in the direction of its length. The transportation belt 51, the moving section 60, and the first motor M1, etc. are assembled onto the unit frame 56.

In the transportation unit 50, the transportation belt 51 is moved to the recording position KP illustrated in FIG. 3 by the moving section 60. Specifically, a worm 66 is fixed to the shaft of the first motor M1, and a worm gear 65 is in meshing engagement with the worm 66. A rotary shaft 64, which is fixed to the worm gear 65 near one end, rotates due to the rotation of the worm gear 65. The two ends of the rotary shaft 64 are rotatably supported by the side plate portions 56L and 56R of the unit frame 56 respectively. At each of two places that are distant from each other in the width direction X, one end of a first link plate 63 is fixed to the rotary shaft 64, and one end of a second link plate 62 is rotatably connected to the other end of the first link plate 63. The first and second link plates 63 and 62 connected in this way constitute the link member 61.

Near each of the two edges of the transportation belt 51 as viewed in the belt width direction, the end of the shaft of the driving roller 52, which causes the transportation belt 51 to turn, is rotatably supported by a belt frame member 55. Near each of the two edges of the transportation belt 51 as viewed in the belt width direction, the end of the shaft of the driven roller 53 is also rotatably supported by the belt frame member 55. In the present embodiment, the belt frame members 55, the driving roller 52 and the driven roller 53 each supported by the belt frame members 55, and the transportation belt 51 stretched with a tension between the driving roller 52 and the driven roller 53 constitute a transportation section 58 (refer to FIG. 10), which transports the paper 14.

In the belt frame member 55 of the present embodiment, the portion that rotatably supports the end of the shaft of the driving roller 52 is a base portion 55*a*, and the portion that rotatably supports the end of the shaft of the driven roller 53 is an extensible portion 55*b*. The extensible portion 55*b* can extend from the base portion 55*a* in a direction of a line connecting the axial center of the driving roller 52 and the axial center of the driven roller 53. The extensible portion 55*b* is urged in a direction of going away from the base portion 55*a* by an urging member that is not illustrated in the drawings. Therefore, the extensible portion 55*b* is configured to apply a predetermined tension to the transportation belt 51 stretched between the driving roller 52 and the driven roller 53. Consequently, the transportation belt 51 stretched between the driving roller 52 and the driven roller 53 is in a tensioned state.

A concave portion 57, which is a groove that has a substantially rectangular shape, is formed in the base portion 55*a* of the belt frame member 55. A pin 67, which has a substantially cylindrical shape, is fixed to the other end of the second link plate 62. The pin 67 is in engagement with the concave portion 57 of the belt frame member 55. As indicated by the solid-line arrow CW in FIG. 3, the rotary shaft 64 rotates in the clockwise direction as viewed from the +X side when it is driven by the first motor M1. The first link plate 63 and the second link plate 62 move due to the rotation of the rotary shaft 64. Since the pin 67, which is on the second link plate 62, is in the concave portion 57, the link plate movement causes the (arc-drawing) movement of the belt frame member 55. Due to the movement of the belt frame member 55, the transportation belt 51 moves to the recording position KP.

As indicated by the broken-line arrow CCW in FIG. 3, the rotary shaft 64 rotates in the counterclockwise direction as viewed from the +X side when it is driven by the first motor M1. The first link plate 63 and the second link plate 62 move due to the rotation of the rotary shaft 64. With the engagement of the pin 67 (refer to FIG. 10), which is on the second link plate 62, the link plate movement causes the movement of the belt frame member 55. Due to the movement of the belt frame member 55, the transportation belt 51 moves to the retracted position TP (in an arc-drawing manner).

The transportation unit 50 after the movement of the transportation belt 51 to the retracted position TP is illustrated in FIG. 4. As illustrated in FIG. 4, in the present embodiment, after the movement of the transportation belt 51 to the retracted position TP, the transportation belt 51 is housed inside the unit frame 56 in the transportation unit 50. In this belt-housed state, the projection area size of the transportation unit 50 as viewed in the unit length direction (width direction X) is the smallest.

As described above, in the present embodiment, the state of pin engagement, that is, the state in which the pin 67 is in the concave portion 57 of the belt frame member 55, is a connected state, in which the movement of the transportation belt 51 between the recording position KP and the retracted position TP by the moving section 60 is enabled. It is possible to disengage the pin 67 by putting it out of the concave portion 57 of the belt frame member 55. This state is a disconnected state, in which the movement of the transportation belt 51 between the recording position KP and the retracted position TP by the moving section 60 is disabled. Therefore, the pin 67 of the second link plate 62 and the concave portion 57 of the belt frame member 55 work together as a connection section 17, which can establish mechanical connection between the transportation belt 51 and the moving section 60, and can disconnect the connection therebetween.

As illustrated in FIGS. 3 and 4, in the present embodiment, a second motor M2, which functions as a transportation driving source, is fixed to the unit frame 56. The second motor M2 causes the transportation belt 51 to turn by causing the driving roller 52 to rotate via transmission gears that are not illustrated in the drawings. The first motor M1, which causes the moving section 60 to operate, is fixed to the side plate portion 56L at the left end (+X direction) of the unit frame 56.

The transportation unit 50 is provided with a rotation detection section that detects the amount of rotation of the driving roller 52. In the present embodiment, an optical rotary encoder using a disc 59 and a photo coupler 69 (refer to FIG. 10) is employed as the rotation detection section. The disk 59 is fixed to the driving roller 52. On the other hand, the photo coupler 69 is fixed to a cover portion 68, which is provided on the side plate portion 56L at the left end (+X direction) of the unit frame 56. Therefore, the photo coupler 69 on the cover portion 68 functions as a detection sensor that detects disc rotation (rotation of the driving roller 52).

Figure 9:
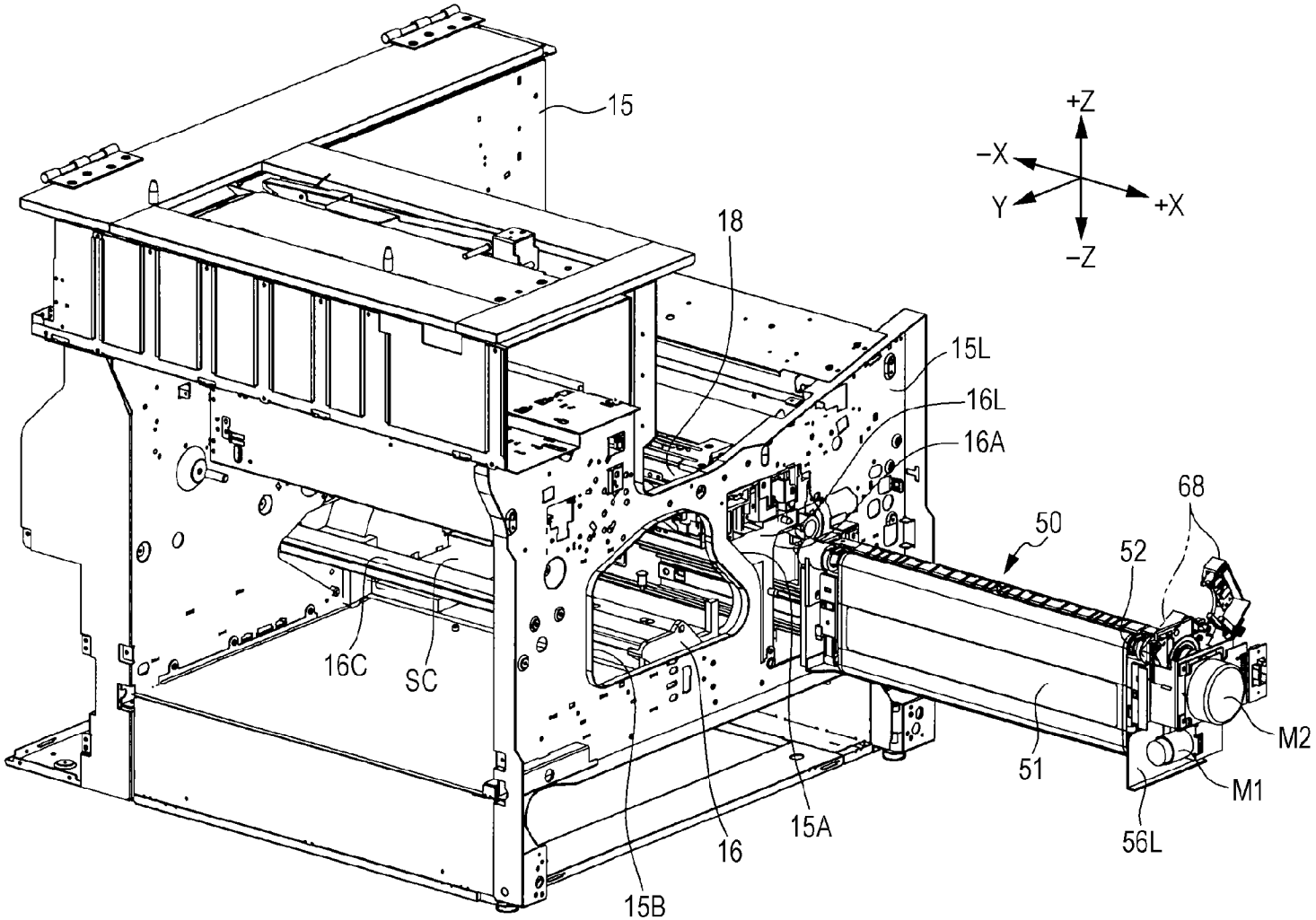
FIG. 9 is a perspective view of the transportation unit in a state in which a cover portion for covering the insertion receptacle of a bearing has been opened to expose the insertion receptacle, wherein the bearing supports the shaft of a roller that causes the transportation belt to turn.
Figure 10:
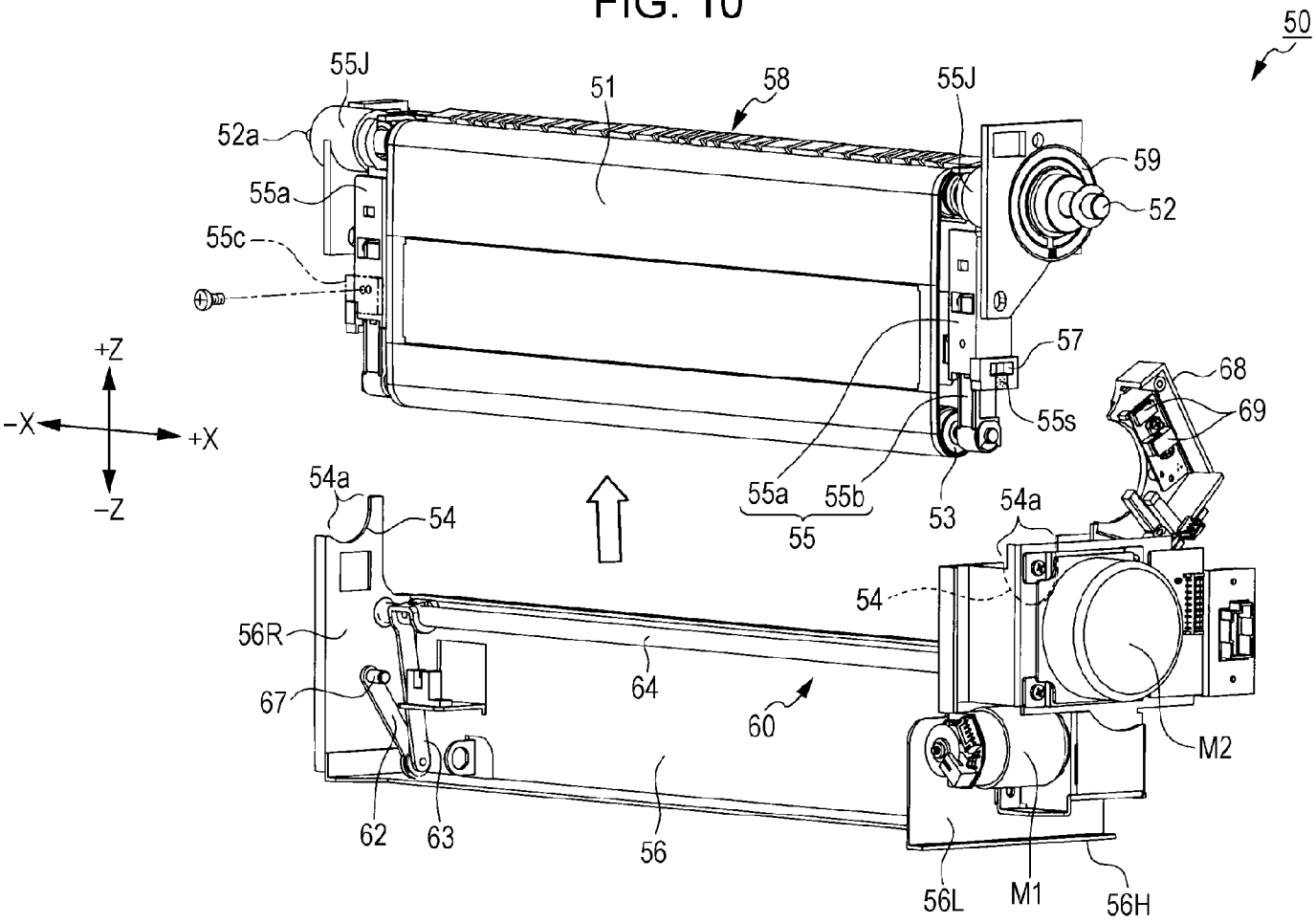
FIG. 10 is a perspective view of the transportation unit after the detachment of the transportation belt.

Each of the side plate portions 56L and 56R of the unit frame 56 has a bearing 54, which supports the shaft of the driving roller 52 rotatably via a roller support portion 55J (refer to FIG. 10). The roller support portion 55J is provided on the base portion 55*a* of the belt frame member 55 and supports the driving roller 52 rotatably (refer to FIG. 10). The bearing 54 has an insertion receptacle 54*a*, into which the shaft of the driving roller 52 (more specifically, the roller support portion 55J of the belt frame member 55) can be inserted (refer to FIG. 10). The cover portion 68 is pivotally supported on the side plate portion 56L of the unit frame 56, and the position of the cover portion 68 can be changed between a closed state, in which the insertion receptacle 54*a* of the bearing 54 formed in the side plate portion 56L is covered, and an open state, in which the insertion receptacle 54*a* is exposed (refer to FIG. 9).

In the present embodiment, the driving roller 52 is configured to rotate in synchronization with the movement of the transportation belt 51 when the transportation belt 51 moves (draws an arc) between the recording position KP and the retracted position TP. Therefore, the detection sensor can detect the position (arc-drawing attitude) the transportation belt 51 on the basis of the amount of rotation of the driving roller 52.

Figure 5:
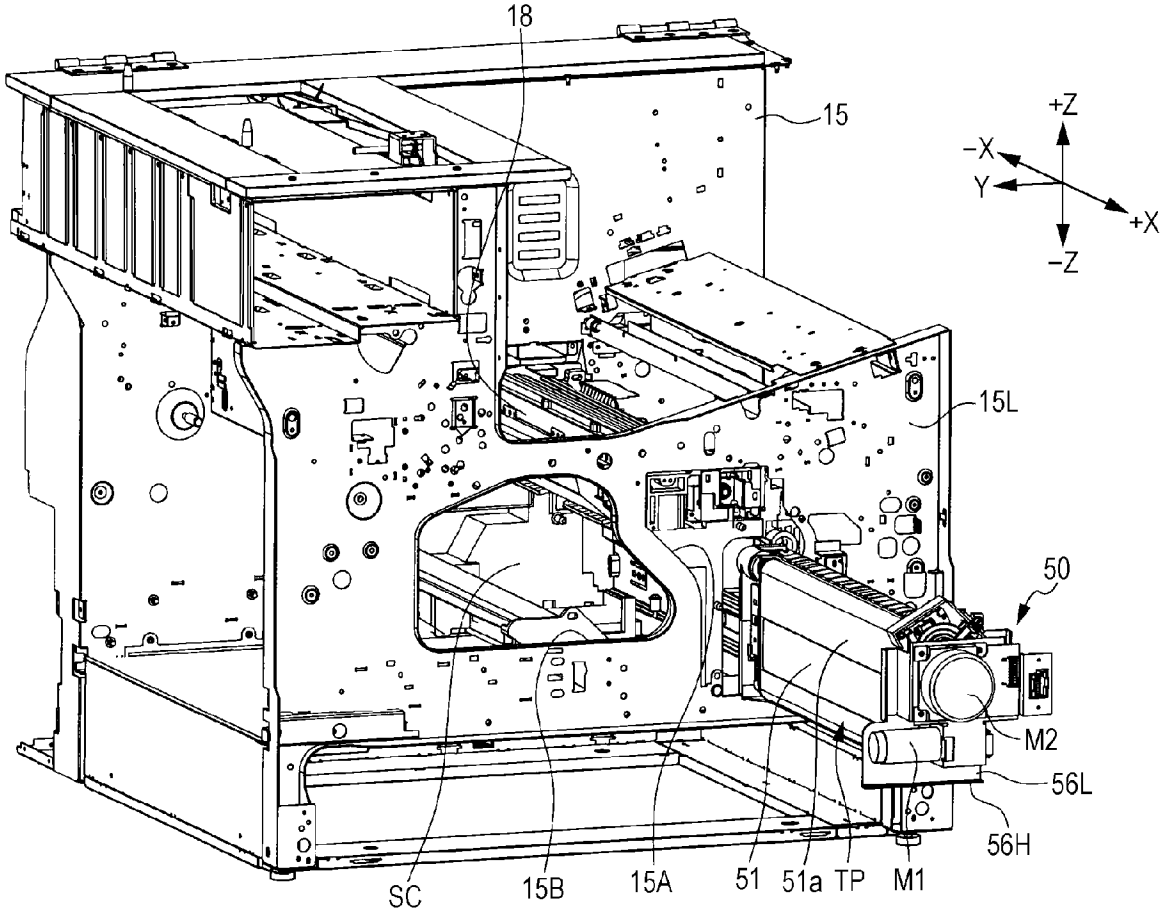
FIG. 5 is a perspective view that illustrates a state in which the transportation unit has been drawn out from the inside of a supporting frame to the outside of an apparatus frame.

As illustrated in FIG. 5, the printer 11 is provided with an apparatus frame 15, which is fixed to the inside of the cabinet 12. The apparatus frame 15 has a shape of a substantially rectangular parallelepiped. A first hole portion 15A (refer to FIG. 5 in conjunction with FIGS. 1 and 2) is formed in its left frame 15L at the +X side in the width direction X. After the movement of the transportation belt 51 to the retracted position TP, the transportation unit 50 can be drawn out from the inside of the apparatus frame 15 through the first hole portion 15A toward the +X side in the width direction X (drawn leftward).

Inside the apparatus frame 15, there is a movement-allowing space SC (refer to FIG. 1), which allows the transportation belt 51 having the belt surface 51*a* to move from the recording position KP to the retracted position TP (or move from the retracted position TP to the recording position KP). The movement-allowing space SC is located at the downstream side in the transportation direction Y with respect to the belt surface 51*a* of the transportation belt 51 after its movement to the retracted position TP. In the present embodiment, for example, a second hole portion 15B, through which a user can insert their hand into the movement-allowing space SC, is formed in the left frame 15L in such a way as not to overlap with the first hole portion 15A in two-dimensional view in the drawing-out direction (+X direction) at the downstream side in the transportation direction Y of the paper 14 with respect to the first hole portion 15A (refer to FIG. 5 in conjunction with FIGS. 1 and 2).

Figure 6:
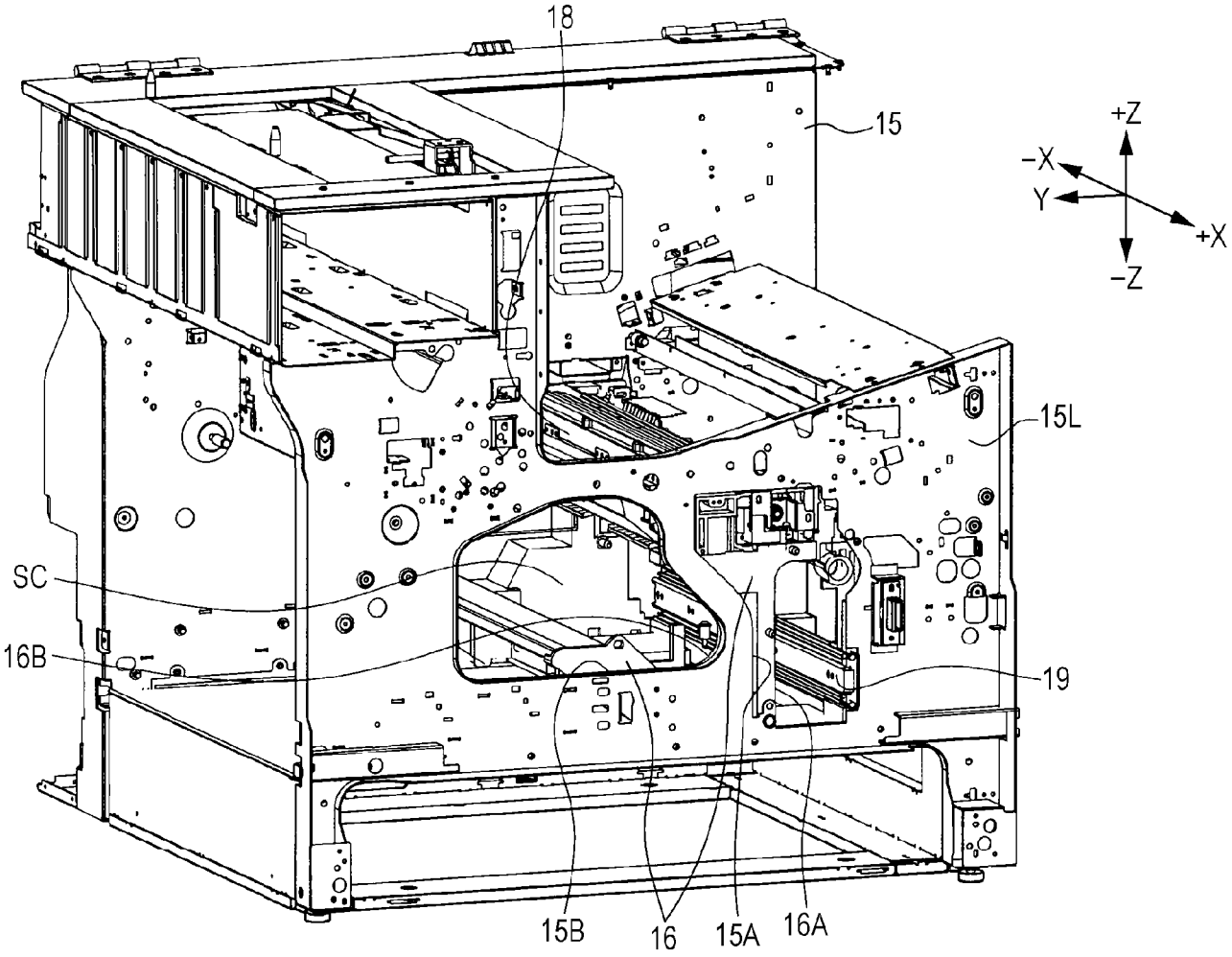
FIG. 6 is a perspective view of the apparatus frame, which has a hole portion through which an opening portion of the supporting frame is exposed.

In addition, as illustrated in FIG. 6, which shows the apparatus frame 15 after the removal of the transportation unit 50, a supporting frame 16, which supports the transportation unit 50 inside, is fixed to, and inside, the apparatus frame 15 by means of a fixing member such as screws not illustrated in the drawings. More specifically, the transportation unit 50 is supported by a slide member 19 (refer to FIG. 8B), which is on the supporting frame 16. In the present embodiment, in the transportation unit 50 supported by the slide member 19 on the supporting frame 16, the transportation belt 51 moves between the recording position KP and the retracted position TP in a state in which the portion to the right (−X side) of the side plate portion 56L of the unit frame 56 is located inside the supporting frame 16.

Figure 7:
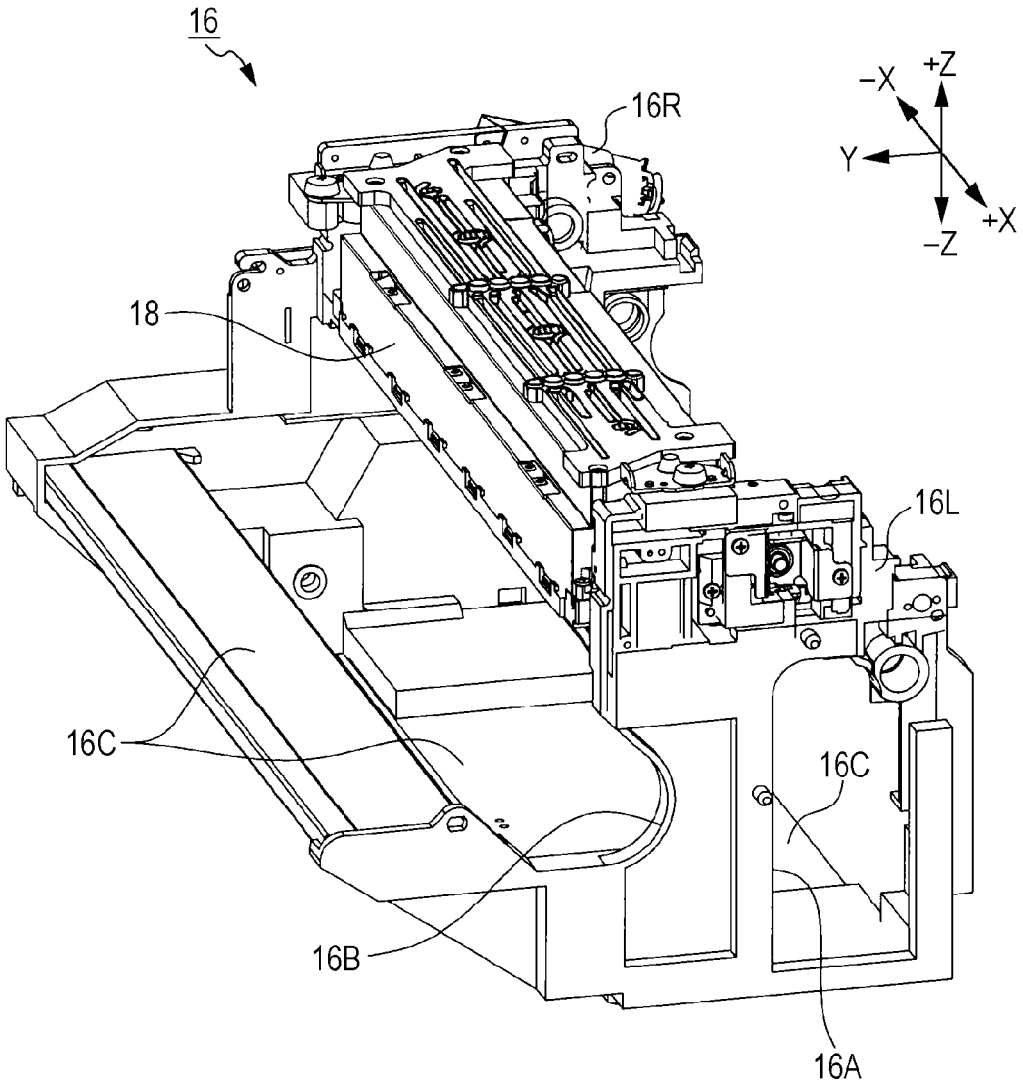
FIG. 7 is a perspective view of the supporting frame, which has an opening portion through which the transportation unit can be drawn out.

As illustrated in FIG. 7, the supporting frame 16 includes a left sidewall portion 16L (+X side) and a right sidewall portion 16R (−X side), which are formed respectively at two opposite ends in the width direction X in relation to each other, and further includes a connecting portion 16C, which extends in the width direction X for connection between the left sidewall portion 16L and the right sidewall portion 16R. A first opening portion 16A, through which, in the transportation unit 50, the portion located inside the supporting frame 16 can be drawn out, is formed in the left sidewall portion 16L of the supporting frame 16. In FIG. 7, the slide member 19 (refer to FIG. 6) is omitted in order to make the first opening portion 16A more visible. As illustrated in FIG. 6, the first hole portion 15A of the apparatus frame 15 is formed at a position where it overlaps with the first opening portion 16A in two-dimensional view in the direction in which the transportation unit 50 is drawn out (+X direction) in such a way as to expose the entire first opening portion 16A.

In addition, as illustrated in FIG. 7, the supporting frame 16 has a second opening portion 16B in the left sidewall portion 16L at the downstream side in the transportation direction Y of the paper 14 with respect to the first opening portion 16A. In the present embodiment, the second opening portion 16B has an arch-cut shape formed in the left sidewall portion 16L. Specifically, this cut portion is arched toward the upstream side in the transportation direction Y in such a way as to reach the −Z side of the recording section 18 in the direction of gravity, in relation to the recording section 18 fixed at the opposite +Z side in the direction of gravity at the left sidewall portion 16L and the right sidewall portion 16R of the respective two ends of the supporting frame 16. As illustrated in FIG. 6, the second hole portion 15B of the apparatus frame 15 is formed at a position where it overlaps with the second opening portion 16B in two-dimensional view in the direction in which the transportation unit 50 is drawn out.

Since the second hole portion 15B, which overlaps with the second opening portion 16B, is formed in the apparatus frame 15, for example, it is easy to take out the paper 14 that is in a so-called jammed state and is therefore hard to be transported (jammed paper removal work). That is, for example, the user of the printer 11 can take out the jammed paper 14 that has become stuck below the recording section 18 inside the supporting frame 16 by inserting their hand into the apparatus frame 15 through the second hole portion 15B and by pulling the jammed paper 14 out to the outside of the apparatus frame 15 from the inside of the supporting frame 16 through the second opening portion 16B and the second hole portion 15B.

Next, the operational effects of the present embodiment, that is, the replacement of the transportation belt 51, will now be explained.

Figures 8A, 8B:
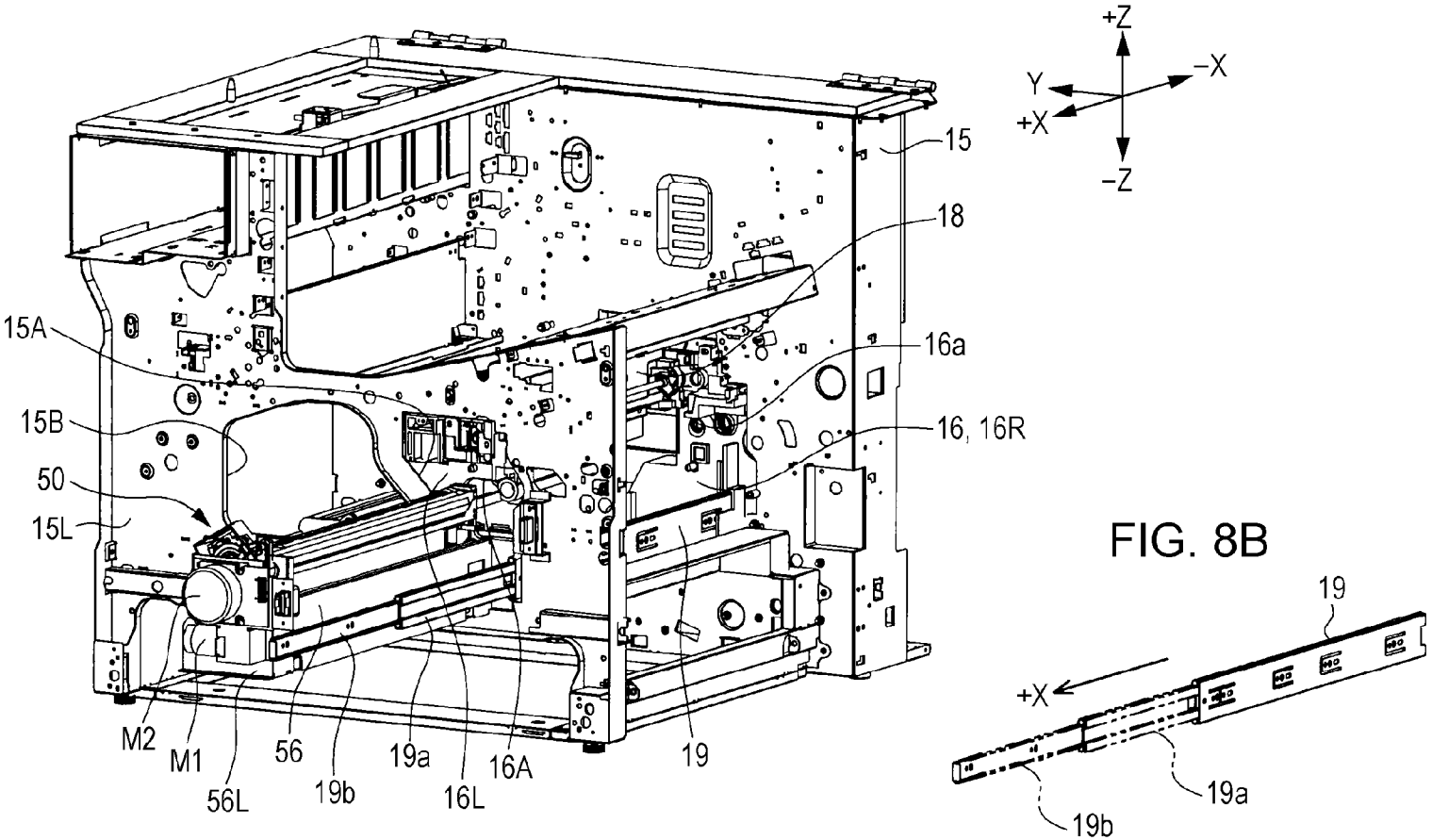
FIG. 8A is a perspective view of the apparatus frame, with the transportation unit being drawn out, wherein the view is taken from a direction different from that of FIG. 5.
FIG. 8B is a perspective view of a slide member that allows the transportation unit to move.

First, as illustrated in FIG. 8A, in a state in which the transportation belt 51 has been moved to the retracted position TP, an operator draws out the entire transportation unit 50 including the first motor M1 and the second motor M2 to the outside of the apparatus frame 15. In this step, the operator holds a grip portion 56H (refer to FIG. 4), which is a bent portion formed in a part (in this example, a lower part) of the unit frame 56 outside the supporting frame 16, that is, the part located at the +X side in the width direction X with respect to the first opening portion 16A of the supporting frame 16, or holds another grip member that is fixed to the grip portion 56H and is not illustrated in the drawings, and draws out the transportation unit 50 in the +X direction. In the present embodiment, the first motor M1 and the second motor M2 are fixed to the part including the side plate portion 56L located at the +X side in the width direction X with respect to the first opening portion 16A of the supporting frame 16, as a part of the unit frame 56, and this part is located at the drawing-out side (+X side) with respect to the first hole portion 15A of the apparatus frame 15.

As illustrated in FIG. 8B, the slide member 19, which is on the supporting frame 16, includes a first slide portion 19*a* and a second slide portion 19*b*, which are extensible in the +X direction as indicated by the dot-dot-dash-line arrow in the drawing from its "before-sliding" state indicated by the solid line (refer to FIG. 6) as a result of this drawing-out operation. The transportation unit 50 is fixed to the second slide portion 19*b*. Due to the extension of the second slide portion 19*b* in the +X direction, which is the drawing-out direction, the transportation unit 50 slides in the +X direction. As a result of this sliding operation, the transportation unit 50 is drawn out smoothly to the outside of the apparatus frame 15 by the slide member 19. In the present embodiment, the entire transportation unit 50 is drawn out of the apparatus frame 15 to the outside of the cabinet 12 of the printer 11 not illustrated in FIG. 8.

In the present embodiment, before the transportation unit 50 is drawn out, a tapered portion 52*a* (refer to FIG. 4), which is formed at the −X end of the shaft of the driving roller 52, is inserted in a round hole portion 16*a*, which is formed in the supporting frame 16 and has a chamfered circumferential face, so as to position the transportation unit 50 with respect to the supporting frame 16. Therefore, as illustrated in FIG. 8A, the tip of the shaft of the driving roller 52 is pulled out of the round hole portion 16*a* smoothly when the transportation unit 50 is drawn out.

Next, as illustrated in FIG. 9, the operator changes the position of the cover portion 68 in the transportation unit 50 from the closed state (state indicated by the dot-dot-dash line in the drawing) to the open state (state indicated by the solid line in the drawing) so as to expose the insertion receptacle 54*a* (refer to FIG. 10) of the bearing 54, which is formed in the unit frame 56 (side plate portion 56L) for supporting the shaft of the driving roller 52. Since transportation unit 50 has already been drawn out to the outside of the cabinet 12 of the printer 11, the operator can do this exposure work easily.

Next, as illustrated in FIG. 10, the operator detaches the transportation belt 51 from the transportation unit 50. In this step, the operator moves the transportation belt 51 in a direction in which the shaft of the driving roller 52 goes out of the exposed insertion receptacle 54*a* of the bearing 54, that is, in the +Z direction, which is the opposite of the direction of gravity, along the belt surface 51*a* as indicated by the blank arrow in FIG. 10. In this process, in the present embodiment, the state between the pin 67 of the second link plate 62 and the concave portion 57 of the belt frame member 55 working together as the connection section 17, which is for mechanical connection between the transportation belt 51 and the moving section 60, changes from the connected state into the disconnected state because of pin disengagement. For simplicity, in FIG. 10, the apparatus frame 15 and the supporting frame 16 are omitted, and the transportation unit 50 only is illustrated.

In the present embodiment, the second link plate 62 is flexible so that it is possible to put the pin 67 out of the concave portion 57 of the belt frame member 55 within the range of the elastic tolerance of the second link plate 62, or the first link plate 63. Therefore, before the detachment of the transportation belt 51 from the transportation unit 50, the operator deforms the second link plate 62 located near each of the two ends of the transportation belt 51 in the width direction X by utilizing its flexibility, and disengages the pin 67 from the concave portion 57 for disconnection.

Alternatively, the following structure may be used instead. In FIG. 10, as indicated by the dot-dot-dash line, the concave portion 57 is formed in a member 55*c* that can be separated from the belt frame member 55. This separable member 55*c* is detachably fastened to the belt frame member 55 (base portion 55*a*) by means of screws or the like. If this alternative structure is employed, the operator unfastens the screws to detach the separable member 55*c* from the belt frame member 55 before the detachment of the transportation belt 51 from the transportation unit 50. By this means, the belt frame member 55 is put into a state in which movement by the pin 67 via the concave portion 57 is disabled, that is, into the disconnected state. In this alternative structure, the separable member 55*c* functions as the connection section.

Alternatively, in FIG. 10, as indicated by the shaded area, a slit 55*s*, which is continuous from the concave portion 57 and extends toward the driven roller 53 along the belt surface 51*a*, may be formed in the belt frame member 55. The slit 55*s* is a groove that allows the pin 67 to move therealong. The direction in which the slit 55*s* extends is orthogonal to the direction in which the belt frame member 55 is urged by the pin 67 when the transportation belt 51 is caused to move (draw an arc). Therefore, when the transportation belt 51 is moved by the moving section 60, the pin 67 does not slip out of the concave portion 57 through the slit 55*s*. On the other hand, the direction in which the operator moves the transportation belt 51 at the time of the detachment of the transportation belt 51 from the transportation unit 50 is the same as the direction in which the slit 55*s* extends. Therefore, when the operator moves the transportation belt 51, the pin 67 can go out of the concave portion 57 through the slit 55*s* easily. That is, the connection section 17 disconnects the connection at the time of the detachment of the transportation belt 51 from the transportation unit 50.

In the present embodiment, the transportation belt 51 that is in a state of being stretched with a tension between the driving roller 52 and the driven roller 53 each supported by the belt frame members 55 is detached from the transportation unit 50. That is, the transportation belt 51 is detached together with the other components of the transportation section 58. Therefore, the operator can do replacement work easily as follows. For example, the operator applies a force to the driven roller 53 toward the driving roller 52 to push the extensible portion 55*b* of the belt frame member 55 in a contracting manner toward the base portion 55*a* thereof, thereby slackening the transportation belt 51 stretched between these two rollers. After that, the operator removes the slack transportation belt 51 from the driving roller 52 and the driven roller 53, and replaces it with a new transportation belt 51. Alternatively, the operator replaces the detached transportation section 58 with a new transportation section 58, which includes a new transportation belt 51 stretched with a tension between a driving roller 52 and a driven roller 53.

The present embodiment produces the following advantageous effects.

(1) The transportation unit 50 can be drawn out to the outside of the supporting frame 16 (the apparatus frame 15) at the retracted position TP, which is comparatively distant from the recording section 18. Therefore, a user/operator can do the replacement work of the transportation belt 51 easily while avoiding contact with the recording section 18.

(2) By disconnecting the transportation belt 51 and the moving section 60 from each other at the connection section 17, for example, it is possible to detach the transportation belt 51 from the transportation unit 50, which makes it easier to do the replacement work of the transportation belt 51.

(3) It is possible to detach the transportation belt 51 from the transportation unit 50 by putting the driving roller 52 inserted in the bearing 54 out of the bearing 54 from the insertion receptacle 54*a* exposed by opening the cover portion 68. Therefore, the user/operator can do the replacement work of the transportation belt 51 easily.

(4) It is possible to cause the transportation belt 51 to move between the recording position KP (first position) and the retracted position TP (second position) with a simple structure of causing the transportation belt 51 to draw an arc around the shaft of the driving roller 52. This structure is simpler than, for example, a parallel movement structure.

(5) The state of the movement of the transportation belt 51 to the retracted position TP can be detected on the basis of the amount of rotation of the driving roller 52. Therefore, it is possible to draw out the transportation unit 50 to the outside of the supporting frame 16 easily.

(6) When the transportation unit 50 is drawn out to the outside of the supporting frame 16, the second motor M2 (transportation driving source) and the first motor M1 (movement driving source) are moved together therewith. Therefore, it is not necessary to provide any separable driving transmission mechanism between the driving source and the transportation/movement mechanism. This makes it possible to avoid the structure of the transportation unit 50 from becoming complex.

(7) The transportation unit 50 can be drawn out of the supporting frame 16 easily through the first opening portion 16A, which is exposed through the first hole portion 15A. In addition, the contact of the transportation unit 50 that is being drawn out with the apparatus frame 15 is prevented. Moreover, since the first hole portion 15A has a hole shape around which peripheral members exist, it is possible to reduce a decrease in the strength of the apparatus frame 15.

(8) The paper 14 jammed during transportation can be taken out of the apparatus frame 15 through the second hole portion 15B. Moreover, since the second hole portion 15B does not overlap with the first hole portion 15A, it is possible to reduce a decrease in the strength of the apparatus frame 15.

(9) The paper 14 jammed during transportation inside the supporting frame 16 can be taken out of the supporting frame 16 to the outside of the apparatus frame 15 easily through the second opening portion 16B, and through the second hole portion 15B overlapping with the second opening portion 16B in two-dimensional view.

The embodiment described above may be modified into other embodiments described below.

In the embodiment described above, it is not always necessary that the supporting frame 16 should have the second opening portion 16B at the downstream side in the transportation direction Y of the paper 14 with respect to the first opening portion 16A. For example, it is not necessary to form the second opening portion 16B in the supporting frame 16 if the recording section 18 is located at a position distant from the first opening portion 16A at the downstream side in the transportation direction Y. In this case, preferably, the second opening portion 16B should be formed in the apparatus frame 15 for, for example, fixing a jam.

In the embodiment described above, it is not always necessary that the second hole portion 15B that does not overlap with the first hole portion 15A in two-dimensional view in the drawing-out direction should be formed in the apparatus frame 15 at the downstream side in the transportation direction Y of the paper 14 with respect to the first hole portion 15A. For example, as long as sufficient strength of the apparatus frame 15 is ensured, the second hole portion 15B may overlap with the first hole portion 15A in two-dimensional view in the drawing-out direction. Alternatively, the second hole portion 15B may be omitted if, for example, jam processing is not necessary.

In the embodiment described above, it is not always necessary that the printer 11 should be provided with the apparatus frame 15, inside which the supporting frame 16 is fixed. In this case, the supporting frame 16 serves also as the apparatus frame of the printer 11. In this case, the first hole portion 15A is the same as the first opening portion 16A.

In the embodiment described above, it is not always necessary that both the first motor M1 functioning as a driving source and the second motor M2 functioning as another driving source should be provided on the transportation unit 50, which is drawn out to the outside of the supporting frame 16. For example, either one of the first motor M1 and the second motor M2 may be provided thereon, or neither of the first motor M1 and the second motor M2 may be provided thereon. In such a modified structure, preferably, the driving source that is not provided on the transportation unit 50 should be provided on, for example, the supporting frame 16, and a driving transmission mechanism that can transmit the power of the driving source to the transportation unit 50 and can disconnect the power transmission thereto should be provided.

In the embodiment described above, it is not always necessary that the photo coupler 69 (detection sensor) for detecting the amount of rotation of the driving roller 52 should be provided on the cover portion 68. For example, the photo coupler 69 may be provided together with the rotary encoder on the unit frame 56, to which the second motor M2 is fixed.

In the embodiment described above, for movement between the recording position KP and the retracted position TP, it is not always necessary that the transportation belt 51 should rotate (draw an arc) around the shaft of the driving roller 52 by 90° in such a way as to turn its belt surface 51*a* from the horizontal orientation (attitude) to the vertical orientation (attitude). For example, the transportation belt 51 may move between the recording position KP and the retracted position TP by rotating (drawing an arc) around the shaft of the driving roller 52 by an angle greater than 90° or by an angle less than 90°. Alternatively, the transportation belt 51 may move between the recording position KP and the retracted position TP by drawing an arc around the shaft of the driven roller 53, instead of the driving roller 52. Alternatively, the transportation belt 51 may move between the recording position KP and the retracted position TP, which is more distant from the recording section 18 than the recording position KP is, by parallel movement, which is translation that does not involve a change in orientation, instead of arc-drawing movement, which involves a change in orientation.

In a structure of the parallel movement of the transportation belt 51, in some cases, a so-called gap adjustment of adjusting the distance between the print surface of the paper 14, which is transported while being electrostatically attracted on the transportation belt 51, and the recording section 18 by the parallel movement of the transportation belt 51 is performed for the purpose of, for example, preventing poor print quality. In such a case, the recording position KP is the position of the transportation belt 51 after the gap adjustment. Corresponding to the most distant position of the transportation belt 51 from the recording section 18 in the gap adjustment, the retracted position TP of the transportation belt 51 in this case is further away from the recording section 18.

In the embodiment described above, it is not always necessary that the transportation unit 50 should be provided with the cover portion 68 for covering the insertion receptacle 54*a* of the bearing 54 formed in the side plate portion 56L at the left end (+X direction) in the width direction X with respect to the transportation belt 51. Specifically, the transportation unit 50 may be additionally provided with the cover portion 68 for covering the insertion receptacle 54*a* of the bearing 54 formed in the side plate portion 56R at the right end (−X direction) in the width direction X with respect to the transportation belt 51.

Alternatively, the cover portion 68 for covering the insertion receptacle 54*a* of the bearing 54 may be omitted from the transportation unit 50. For example, the left end (+X direction) of the shaft of the driving roller 52 may be inserted into a round-hole bearing formed in the side plate portion 56L at the left end (+X direction). In such a structure, when in a state of being pushed into the supporting frame 16, the tapered portion 52*a* at the pushed-in-side end of the driving roller 52 is positioned by a circular hole portion 16*a* formed in the supporting frame 16, and the drawn-out-side end of the driving roller 52 is positioned by the round-hole bearing. After the drawing of the transportation unit 50 out of the supporting frame 16, it is possible to detach the transportation section 58 from the transportation unit 50 by pulling the driving roller 52 out of the round-hole bearing formed in the side plate portion 56L at the left end (+X direction).

In the embodiment described above, in the transportation unit 50, it is not always necessary that the connection section 17 should be provided between the transportation belt 51 and the moving section 60. That is, the transportation belt 51 may be always in the connected state, in which the movement of the transportation belt 51 by the moving section 60 is enabled. In this case, though not illustrated in the drawings, in the transportation unit 50 that has been drawn out to the outside of the apparatus frame 15, the first motor M1 is driven to move the transportation belt 51 to the recording position KP. In the transportation section 58 after the movement of the transportation belt 51 to the recording position KP, the operator applies a force to the driven roller 53 toward the driving roller 52 to push the extensible portion 55*b* of the belt frame member 55 in a contracting manner toward the base portion 55*a* thereof. As a result, the transportation belt 51, which was stretched between these two rollers, slackens. The operator can remove the slack transportation belt 51 from the driving roller 52 and the driven roller 53, and replaces it with a new transportation belt 51.

In the embodiment described above, the recording section 18 is not limited to a so-called line liquid ejecting head that is capable of ejecting ink simultaneously almost throughout the entire area in the width direction X of the paper 14. For example, the recording section 18 may have a so-called serial head structure, in which a liquid ejecting head that ejects ink is provided on a carriage that reciprocates in the width direction X intersecting with the transportation direction of the paper 14. If the serial head structure is employed, the length direction of the recording section 18 is the movement direction of the carriage, and the paper 14 is transmitted intermittently in the transportation direction.

In the embodiment described above, the source of supply of ink that is recording liquid ejected from the recording section 18 may be, for example, an ink container that is provided inside the apparatus frame 15 of the printer 11. Alternatively, it may be a so-called external-attachment-type ink container that is provided outside the apparatus frame 15. With an external-attachment-type ink container, since it is possible to increase ink capacity, it is possible to eject a larger amount of ink from the recording section 18.

In a case where ink is supplied from an ink container provided outside the apparatus frame 15 to the recording section 18, it is necessary to connect and route an ink supply tube, through which the ink is supplied, from the outside to the inside of the cabinet 12 fixed to the apparatus frame 15. Therefore, in this case, preferably, a hole or a slit through which the ink supply tube can be inserted should be formed in the cabinet 12. Alternatively, a clearance may be formed in the cabinet 12, and the ink supply tube may be routed from the outside to the inside of the cabinet 12 through the clearance. With this structure, it is possible to supply ink to the recording section 18 easily by using the ink flow passage of the ink supply tube.

The printer 11, as an example of a recording apparatus, may be a fluid ejecting apparatus that ejects or discharges other fluid (including but not limited to liquid, a liquid material that is produced as a result of dispersion or mixture of particles of a functional material into/with liquid, a gel fluid or the like, a solid substance that can be ejected as a fluid) instead of ink. For example, it may be a liquid ejecting apparatus that performs printing by ejecting liquid that contains a dispersed or dissolved material such as a color material (pixel material) or an electrode material used in the manufacturing of a liquid crystal display, an electroluminescence (EL) display, a surface emission display, or the like. It may be a fluid ejection apparatus that ejects a fluid such as gel (e.g., physical gel), or a powder/particle ejection apparatus that ejects a powdery solid matter, for example, toner powder (particles) (e.g., toner-jet recording apparatus). The invention can be applied to various fluid ejecting apparatuses, including but not limited to any of these kinds of apparatus. In the description of this specification, the term "fluid" is defined as a broad generic concept that encompasses a variety of fluid substance excluding "gas-only" fluid. For example, the fluid includes but not limited to liquid (including, inorganic solvent, organic solvent, solution, liquid resin, liquid metal (metal melt)), a liquid substance, a fluid substance, and a particulate substance (including, particles and powder).

The entire disclosure of Japanese Patent Application No.: 2015-043491, filed Mar. 5, 2015 is expressly incorporated by reference herein.

What is claimed is:

1. A recording apparatus, comprising:

a recording section that performs recording on a recording target medium;

a transportation unit that includes, a transportation belt that is capable of transporting the recording target medium by turning, and a moving section that causes the transportation belt to move between a first position, at which the recording is performed by the recording section, and a second position, which is more distant from the recording section than the first position is; and a supporting frame that supports the transportation unit inside, wherein an opening portion is formed in the supporting frame, and wherein, through the opening portion, the transportation unit supported inside the supporting frame can be drawn out from inside of the supporting frame to outside of the supporting frame in a state in which the transportation belt has been moved to the second position.

2. The recording apparatus according to claim 1, further comprising:

a connection section for mechanical connection between the transportation belt and the moving section, wherein a state of the connection section can be switched between a connected state, in which the movement of the transportation belt between the first position and the second position by the moving section is enabled, and a disconnected state in which the movement therebetween is disabled.

3. The recording apparatus according to claim 1, wherein the transportation unit includes, a driving roller that causes the transportation belt to turn by rotating, a bearing that has an insertion receptacle into which a shaft of the driving roller can be inserted, and rotatably supports the shaft inserted into the insertion receptacle, and a cover portion whose position can be changed between a closed state, in which the insertion receptacle of the bearing is covered, and an open state, in which the insertion receptacle is exposed.

4. The recording apparatus according to claim 3, wherein the transportation belt moves between the first position and the second position by drawing an arc around the shaft of the driving roller.

5. The recording apparatus according to claim 4, wherein a detection sensor for detecting an amount of rotation of the driving roller is provided on the cover portion.

6. The recording apparatus according to claim 5, further comprising:

an apparatus frame inside which the supporting frame is fixed, wherein a hole portion through which the entire opening portion formed in the supporting frame is exposed is formed in the apparatus frame at a position where the hole portion overlaps with the opening portion in two-dimensional view in a direction in which the transportation unit is drawn out.

7. The recording apparatus according to claim 6, wherein, when the hole portion is defined as a first hole portion, a second hole portion that does not overlap with the first hole portion in two-dimensional view in the drawing-out direction mentioned above is formed in the apparatus frame at a downstream side in a transportation direction of the recording target medium with respect to the first hole portion.

8. The recording apparatus according to claim 7, wherein, when the opening portion is defined as a first opening portion, a second opening portion is formed in the supporting frame at the downstream side in the transportation direction of the recording target medium with respect to the first opening portion; and wherein the second hole portion of the apparatus frame is formed at a position where the second hole portion overlaps with the second opening portion of the supporting frame in two-dimensional view in the drawing-out direction mentioned above.

9. The recording apparatus according to claim 1, wherein either a transportation driving source that causes the transportation belt to turn or a movement driving source that drives the moving section so as to cause the transportation belt to move between the first position and the second position, or both, is or are provided on the transportation unit.

10. The recording apparatus according to claim 1, further comprising:

an apparatus frame inside which the supporting frame is fixed, wherein a hole portion through which the entire opening portion formed in the supporting frame is exposed is formed in the apparatus frame at a position where the hole portion overlaps with the opening portion in two-dimensional view in a direction in which the transportation unit is drawn out.

11. The recording apparatus according to claim 10, wherein, when the hole portion is defined as a first hole portion, a second hole portion that does not overlap with the first hole portion in two-dimensional view in the drawing-out direction mentioned above is formed in the apparatus frame at a downstream side in a transportation direction of the recording target medium with respect to the first hole portion.

12. The recording apparatus according to claim 11, wherein, when the opening portion is defined as a first opening portion, a second opening portion is formed in the supporting frame at the downstream side in the transportation direction of the recording target medium with respect to the first opening portion; and wherein the second hole portion of the apparatus frame is formed at a position where the second hole portion overlaps with the second opening portion of the supporting frame in two-dimensional view in the drawing-out direction mentioned above.

* * * * *